US011197080B2

(12) United States Patent
Liu

(10) Patent No.: US 11,197,080 B2
(45) Date of Patent: Dec. 7, 2021

(54) EARPHONE

(71) Applicant: GUANGDONG OPPO MOBILE TELECOMMUNICATIONS CORP., LTD., Guangdong (CN)

(72) Inventor: Bo Liu, Guangdong (CN)

(73) Assignee: SHENZHEN HEYTAP TECHNOLOGY CORP., LTD., Guangdong (CN)

( * ) Notice: Subject to any disclaimer, the term of this patent is extended or adjusted under 35 U.S.C. 154(b) by 0 days.

(21) Appl. No.: 16/880,511

(22) Filed: May 21, 2020

(65) Prior Publication Data

US 2020/0382856 A1 Dec. 3, 2020

(30) Foreign Application Priority Data

May 28, 2019 (CN) ..... 201910449252.5
May 28, 2019 (CN) ..... 201920788583.7

(51) Int. Cl.
*H04R 1/10* (2006.01)
*H04R 1/28* (2006.01)
*H04R 11/02* (2006.01)

(52) U.S. Cl.
CPC ..... *H04R 1/1016* (2013.01); *H04R 1/1075* (2013.01); *H04R 1/1091* (2013.01); *H04R 1/2826* (2013.01); *H04R 11/02* (2013.01)

(58) Field of Classification Search
CPC ..... H04R 1/10; H04R 1/1016; H04R 1/1041; H04R 1/1075; H04R 1/1091; H04R 1/28; H04R 1/2823; H04R 1/2826; H04R 1/2846; H04R 1/2849; H04R 11/02; H04R 2460/09; H04R 2460/11
See application file for complete search history.

(56) References Cited

U.S. PATENT DOCUMENTS

2011/0176700 A1* 7/2011 Hashimoto ..... H04R 1/1016 381/380
2012/0207337 A1 8/2012 Tiscareno et al.
2012/0217087 A1* 8/2012 Ambrose ..... H04R 1/1091 181/130
2013/0148830 A1* 6/2013 Sakaguchi ..... H04R 1/2873 381/312

(Continued)

FOREIGN PATENT DOCUMENTS

CN 202004931 10/2011
CN 202587329 12/2012

(Continued)

OTHER PUBLICATIONS

EPO, Extended European Search Report for EP Application No. 20174549.4, dated Sep. 28, 2020.

(Continued)

*Primary Examiner* — Thang V Tran
(74) *Attorney, Agent, or Firm* — Hodgson Russ LLP

(57) ABSTRACT

An earphone includes a housing, a first eartip, and a second eartip. The housing defines a vent hole therein. The first eartip is configured to be mounted on the housing and cover the vent hole. The second eartip is configured to be mounted on the housing and exposing the vent hole. The housing selectively cooperates with one of the first eartip and the second eartip.

20 Claims, 10 Drawing Sheets

(56) References Cited

U.S. PATENT DOCUMENTS

| | | | | |
|---|---|---|---|---|
| 2014/0102461 | A1* | 4/2014 | Girotra | A61M 31/00 128/864 |
| 2016/0361204 | A1* | 12/2016 | Girotra | A61F 11/00 |
| 2017/0094384 | A1 | 3/2017 | Trainer et al. | |
| 2018/0070165 | A1* | 3/2018 | Hatfield | H04R 1/1016 |
| 2018/0295455 | A1* | 10/2018 | Eichfeld | H04R 25/70 |
| 2020/0074662 | A1* | 3/2020 | Williams | H04R 1/1016 |

FOREIGN PATENT DOCUMENTS

| | | |
|---|---|---|
| CN | 204578734 | 8/2015 |
| CN | 105451109 | 3/2016 |
| CN | 205142465 | 4/2016 |
| CN | 205622807 | 10/2016 |
| CN | 205793193 | 12/2016 |
| CN | 108429971 | 8/2018 |
| CN | 210093459 | 2/2020 |

OTHER PUBLICATIONS

WIPO, ISR for PCT/CN2020/089854, dated Jul. 29, 2020.
IPI, Office Action for IN Application No. 202014020925, dated Jun. 29, 2021.

* cited by examiner

EARPHONE

CROSS-REFERENCE TO RELATED APPLICATION

This application claims priority to Chinese Patent Application No. 201920788583.7, filed May 28, 2019, and Chinese Patent Application No. 201910449252.5, filed May 28, 2019. The entire disclosures of the above-identified applications are incorporated by reference herein.

TECHNICAL FIELD

The present disclosure relates to the field of earphones in general. More particularly, and without limitation, the disclosed embodiments relate to earphone.

BACKGROUND

Nowadays, entertainment such as listening to music and watching movies have become an important way for people to relax. And earphones are usually used in consuming such entertainment.

SUMMARY

According to a first aspect of the present disclosure, an earphone is provided. The earphone includes a housing, a first eartip, and a second eartip. The housing defines a vent hole therein. The first eartip is configured to be mounted on the housing and cover the vent hole. The second eartip is configured to be mounted on the housing and exposing the vent hole. The housing selectively cooperates with one of the first eartip and the second eartip.

According to a second aspect of the present disclosure, an earphone configured to be adapted with an auditory meatus is provided. The earphone includes a housing having an end surface and a side surface connected to an outer periphery of the end surface, a first eartip configured to be mounted on the housing detachably, and a second eartip configured to be mounted on the housing detachably and define a vent channel cooperatively with the housing. The vent channel communicates with the inside and the outside of the housing. The housing selectively cooperates with one of the first eartip and the second eartip; the first eartip is in contact with the side surface when engaged with the housing, and the first eartip is in contact with the auditory meatus when received in the auditory meatus. A cross-sectional size of the second eartip is smaller than a size of the end surface, and the second eartip is in contact with the auditory meatus when received in the auditory meatus.

According to a third aspect, an earphone configured to be adapted with an auditory meatus is provided. The earphone defines a vent channel therein and includes a housing, a first eartip, and a second eartip. The first eartip and the second eartip are both configured to be detachably cooperated with the housing. The earphone is configured to switch between a first configuration that the housing is engaged with the first eartip and a second configuration that the housing is engaged with the second eartip. The first eartip separates the vent channel from outside when engages with the housing. The vent channel is in communication with outside when the earphone engages with the housing. A distance between the housing and an end of the first eartip that is far away from the housing is smaller or equal to a distance between the housing and an end of the second eartip that is far away from the housing.

BRIEF DESCRIPTION OF THE DRAWINGS

In order to explain the technical solutions in the embodiments of the present disclosure or the prior art more clearly, the drawings used in the description of the embodiments or the prior art are briefly introduced below. Obviously, the drawings in the following description are merely some embodiments of the present disclosure. For those of ordinary skill in the art, other drawings can be obtained according to these drawings without paying creative labor.

DETAILED DESCRIPTION OF EMBODIMENTS

Figure 1:
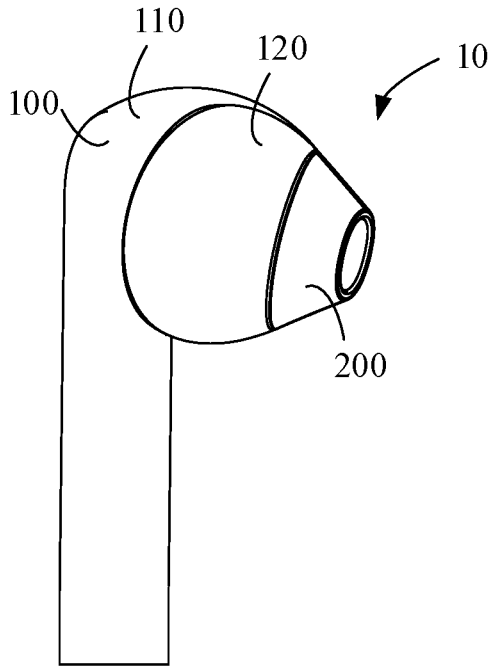
FIG. 1 illustrates a perspective view of an earphone with a first eartip mounted on a housing of the earphone, in accordance with an embodiment of the present disclosure.

In order to facilitate understanding of the present disclosure, the present disclosure will be described more fully with reference to the related drawings. The drawings show the preferred embodiments of the present disclosure. However, this disclosure can be implemented in many different forms and is not limited to the embodiments described herein. Rather, these embodiments are provided to provide a thorough and comprehensive understanding of the disclosure of this disclosure.

As illustrated in FIGS. 1 to 4, an earphone 10 is provided according to an embodiment of the present disclosure. The earphone 10 includes a housing 100, a first eartip 200, a second eartip 300, and a speaker 130 (illustrated in FIG. 9). The first eartip 200 and the second eartip 300 is configured to detachably cooperate with the housing 100 to change a configuration of the earphone 10. The speaker 130 is received in the housing 100.

Figure 3:
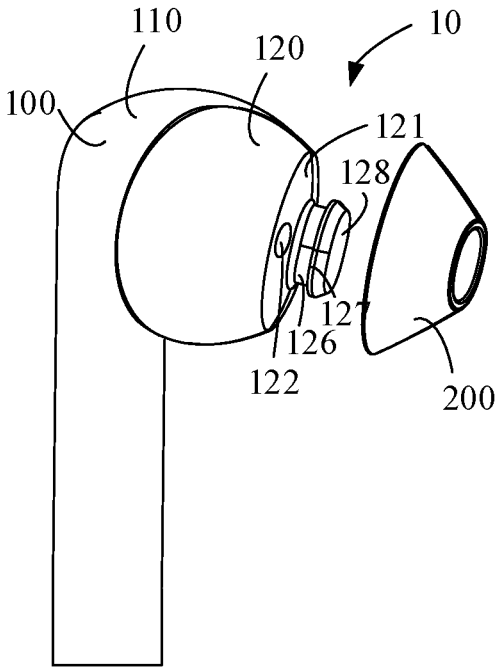
FIG. 3 illustrates a perspective view of the earphone of FIG. 1, wherein the first eartip is apart from the housing.

As illustrated in FIGS. 1 and 3, the first eartip 200 is flexible and can be assembled to and detached from the housing 100. When the first eartip 200 is assembled to the housing 100, a distance between an end of the first eartip 200 away from the housing 100 and the housing 100 is L1 (illustrated in FIG. 11). In some embodiment, the first eartip 200 is made of silicon.

Figure 2:
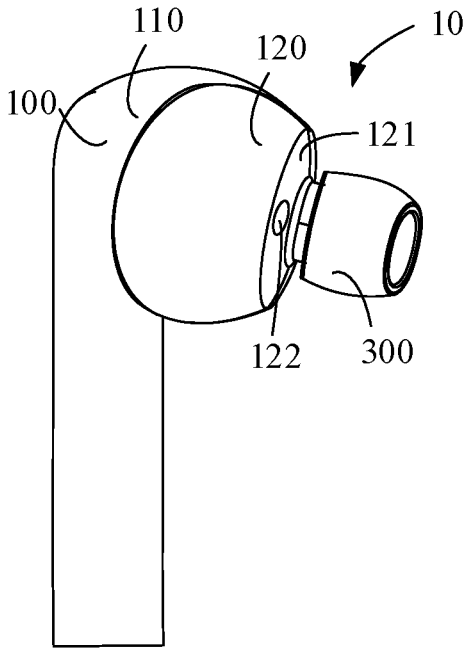
FIG. 2 illustrates a perspective view of an earphone with a second eartip mounted on the housing of the earphone, in accordance with another embodiment of the present disclosure.
Figure 4:
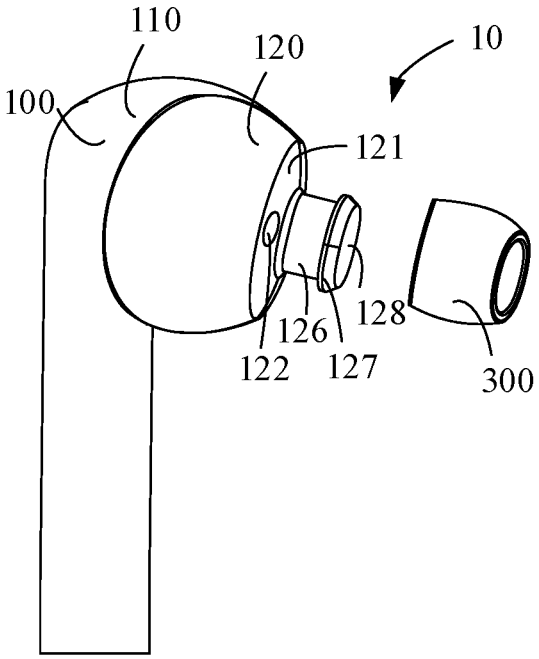
FIG. 4 illustrates a perspective view of the earphone of FIG. 2, wherein the second eartip is apart from the housing.

As illustrated in FIGS. 2 and 4, the second eartip 300 is flexible, and can be assembled to and detached from the housing 100. When the second eartip 300 is assembled on the housing 100, a distance between an end of the second eartip 300 away from the housing 100 and the housing 100 is L2 (illustrated in FIG. 13). L2 is greater than or equal to L1. Thus a distance that the first eartip 200 extends in the auditory meatus 20 is smaller than a distance that the first eartip 300 extends in the auditory meatus 20 when received in the auditory meatus 20. In some embodiment, the second eartip 300 is made of silicon. When the second eartip 300 is assembled to the housing 100, the inner cavity of the housing 100 can communicate with the outside, thus the housing 100 is easy to ventilate. In the description, terms "communicate(s) with" and "in communication with" may indicate that two cavities which respectively defined by two object are connected with each other. For example, a first cavity in a first vessel communicates with a second cavity in a second vessel by connecting the second vessel to the first vessel, such as a communicating vessel.

Figure 5:
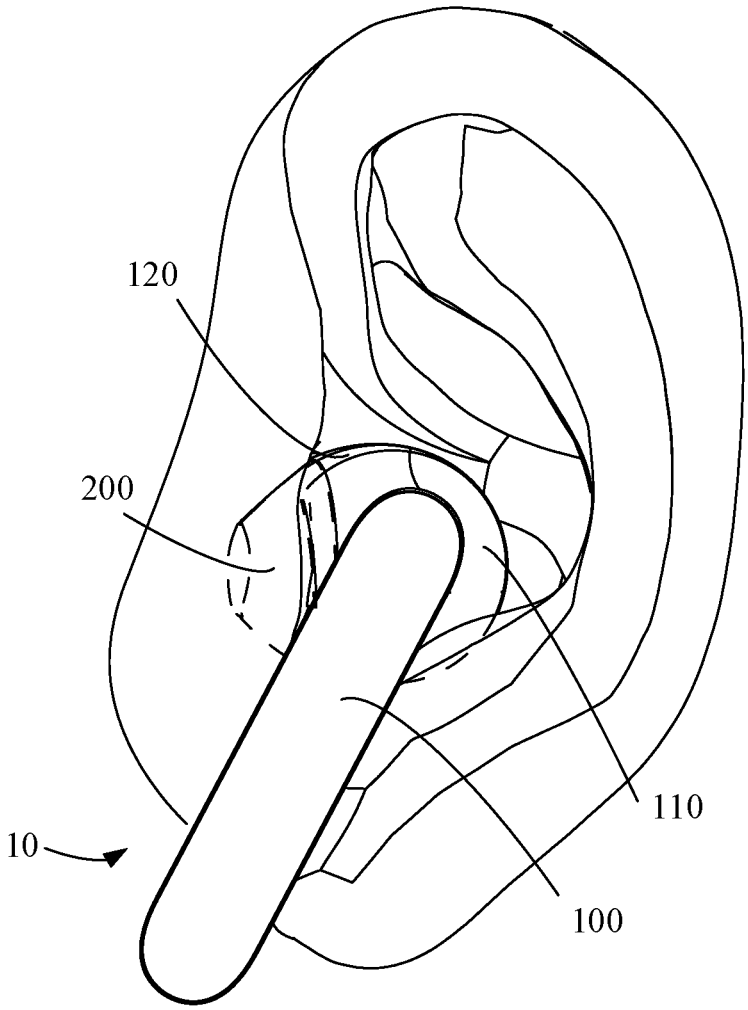
FIG. 5 illustrates a perspective view of the earphone of FIG. 1 in a working state.
Figure 6:
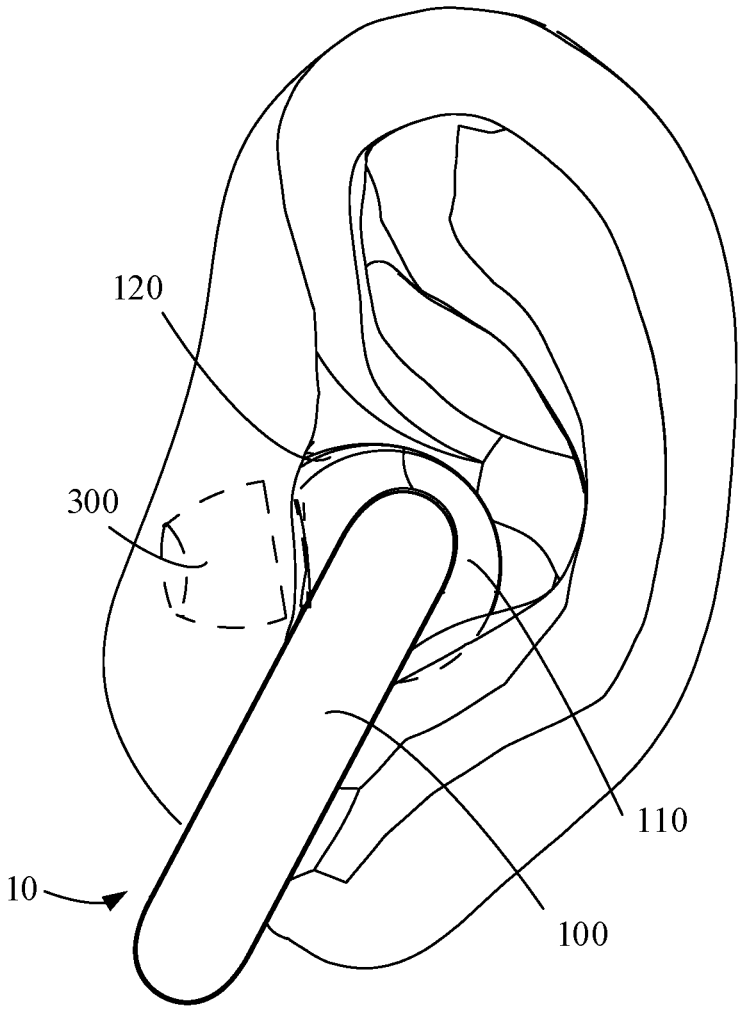
FIG. 6 illustrates a perspective view of the earphone of FIG. 2 in a working state.

When the first eartip 200 is assembled to the housing 100, the earphone 10 has a structure of a semi-in-ear earphone. As illustrated in FIG. 5, when a user wears the earphone 10 with the first eartip 200, the first eartip 200 is inserted into the auditory meatus 20, and a depth that the earphone 10 extends in the auditory meatus 20 is relative small. When the second eartip 300 is assembled to the housing 100, the earphone 10 has a structure of an in-ear earphone. As illustrated in FIG. 6, when the user wears the earphone 10 with the second eartip 300, the second eartip 300 inserts into the auditory meatus 20, and a depth that the earphone 10 extends in the auditory meatus 20 is larger than that of the first eartip 200.

According to the illustrated embodiment, the earphone 10 can switch between two configurations by equipping with the first eartip 200 and the second eartip 300. The two configurations include a first configuration and a second configuration. In the first configuration, the first eartip 200 is detachably connected to the housing 100, and the first eartip 200 is deformed and in contact with the auditory meatus 20 when received in the auditory meatus 20. In the second configuration, the second eartip 300 is detachably connected to the housing 100, and the second eartip 300 is deformed and in contact with the auditory meatus 20 when received in the auditory meatus 20. A distance that the first eartip 200 extends in the auditory meatus is smaller than a distance that the first eartip 200 extends in the auditory meatus when received in the auditory meatus.

Figure 7:
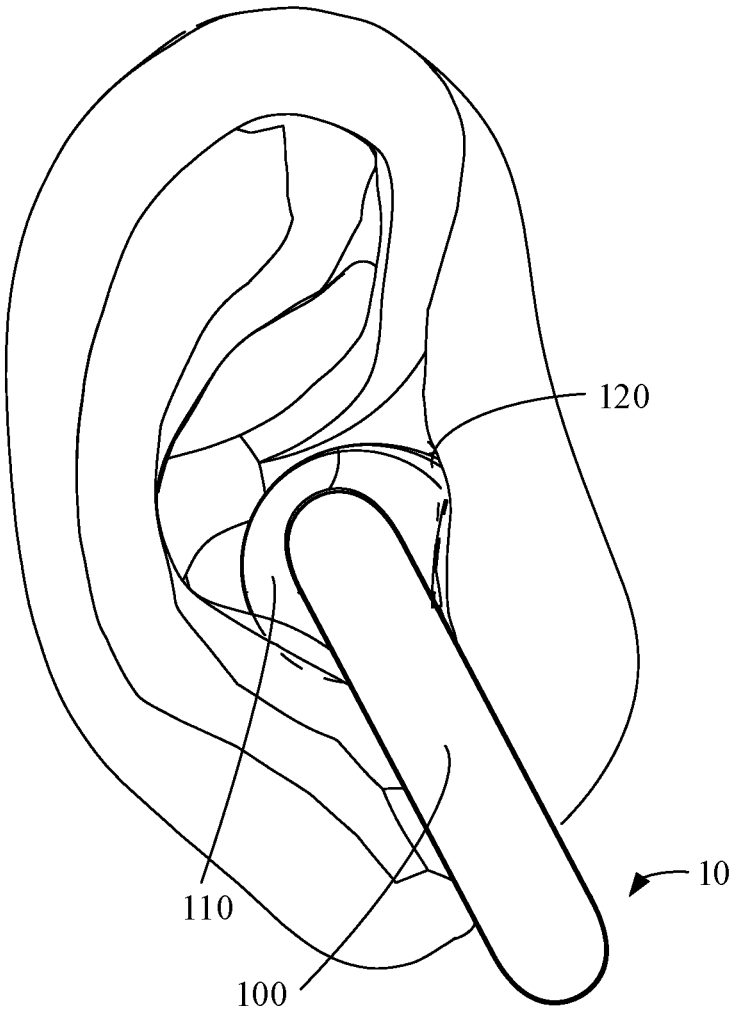
FIG. 7 illustrates a perspective view of an earphone in a working state, in accordance with still another embodiment of the present disclosure.
Figure 8:
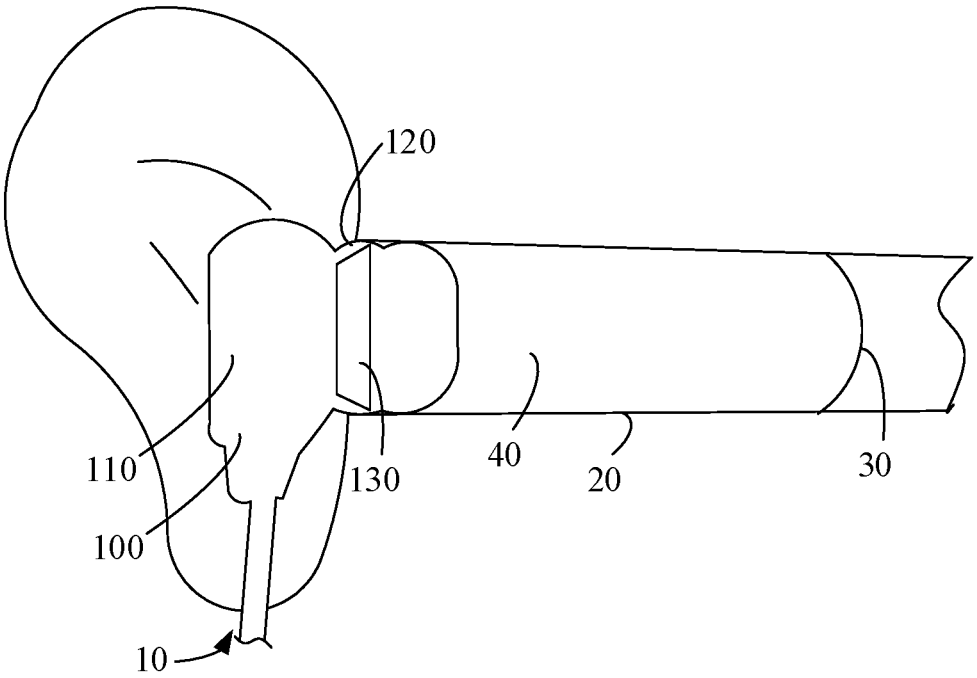
FIG. 8 illustrates a cross-sectional view of the earphone of FIG. 7.

As illustrated in FIG. 7 and FIG. 8, when the user wears the earphone 10 normally, the speaker 130, the housing 100, the auditory meatus 20, and an eardrum 30 of the user cooperatively form a cavity, which is referred to a front cavity 40 of the earphone 10. The acoustic characteristics of the front cavity 40 directly affect the acoustic performance of the earphone 10. The acoustic characteristics of the front cavity 40 mainly include the volume and airtightness of front cavity 40. The acoustic performance of the earphone 10 mainly includes a frequency response and a resonance frequency. The airtightness of the front cavity 40 of a semi-in-ear headphone and the airtightness of an in-ear headphone are significant different. Therefore, under same conditions, there is a significant difference in the acoustic performances of the semi-in-ear headphone and the in-ear headphone. By changing the airtightness of the front cavity 40, that is, changing the airtightness in the auditory meatus, the acoustic performance of the earphone 10 can be changed.

In the earphone 10 of the present disclosure, the first eartip 200 and the second eartip 300 can be detachably assembled to the housing 100, which can change the distance that the earphone 10 extends in the auditory meatus. So that the earphone 10 can switch between a semi-in-ear earphone and an in-ear earphone, and the acoustic characteristics of the front cavity 40 may be adjusted, thereby adjusting the acoustic performance of the earphone 10.

When the first eartip 200 is mounted on the housing 100, the earphone 10 works as a semi-in-ear earphone. When the user wears the earphone 10 with the first eartip 200, the first eartip 200 is at least partially received in the auditory meatus 20, which does not generate pressure on the auditory meatus 20, and the first eartip 200 is not easy to detach from the auditory meatus 20, and the user experience is better. When the first eartip 200 is received in the auditory meatus 20, the first eartip 200 can cooperate well with the auditory meatus 20, which may achieve a good sound insulation, and makes the airtightness of the front cavity 40 better, and improves the acoustic performance of the earphone 10.

In an embodiment, the earphone 10 defines a vent channel therein. The vent channel is configured to ventilate the housing 100 or the front cavity 40. In one embodiment, the vent channel may be a through hole defined in the housing 100, and the through hole may be in communication with outside the housing 100. In another embodiment, the vent channel may be a notch defined in the housing 100 or defined in the second eartip 300, and the notch may be in communication with an interior cavity of the housing 100 and outside the housing 100. In a still another embodiment, the vent channel may be a gap defined between the housing 100 and the second eartip 300, and the gap may be in communication with an interior cavity of the housing 100 and outside the housing 100.

When the second eartip 300 is mounted on the housing 100, the earphone 10 works as an in-ear earphone. When the user wears the earphone 10 with the second eartip 300, the second eartip 300 is at least partially received in the auditory meatus 20, and the vent channel is in communication with the auditory meatus 20, which does not generate pressure on the auditory meatus 20, and the second eartip 300 is not easy to detach from the auditory meatus 20, and the user experience is better. When the second eartip 300 is mounted on the housing 100, the vent channel can reduce the airtightness of the front cavity 40, thereby avoiding a pressure difference between the auditory meatus 20 and the outside world, and thereby avoiding an echo of the sound when speaking. Therefore an openness of the sound quality of the earphone 10 is improved. When the second eartip 300 is assembled to the housing 100, the depth that the earphone 10 extends in the auditory meatus 10 is smaller than that of a common in-ear earphone. So that the problem of intrusive feeling when the user wears the earphone 10 can be weakened. The airtightness of the front cavity 40 that is defined by the earphone 10 equipped with the first eartip 200 is substantially approximate to the airtightness of the front cavity 40 that is defined by the earphone 10 equipped with the second eartip 300. So that the earphone 10 may have similar acoustic characteristics in both conditions of the earphone 10 when equipped with the first eartip 200 and the second eartip 300. The sound qualities in both the two conditions are not easily affected.

Figure 9:
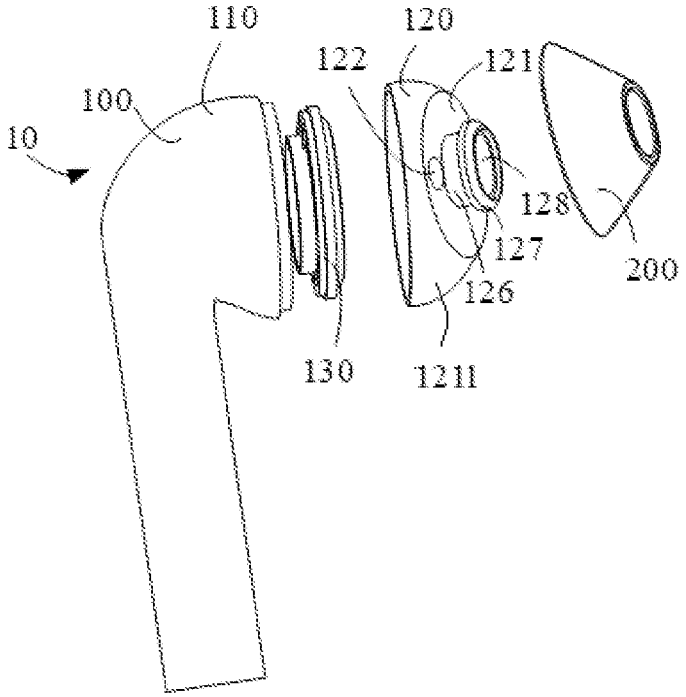
FIG. 9 illustrates an exploded view of the earphone of FIG. 1.
Figure 10:
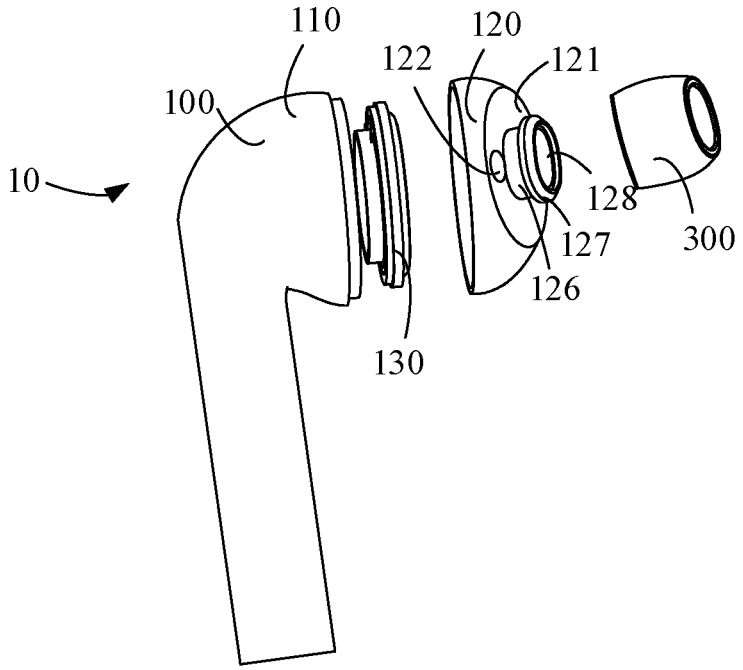
FIG. 10 illustrates an exploded view of the earphone of FIG. 2.

As illustrated in FIGS. 9 and 10, in an embodiment, the housing 100 includes a rear case 110, a front cover 120 connect to the rear case 110, and a sound emitting nozzle 126 connected to the front cover 120.

In an embodiment, the front cover 120 includes an end surface 121 and a side surface 1211 connected the end surface 121. The end surface 121 is disposed at an end of the front cover 120. The side surface 1211 is connected to an outer periphery of the end surface 121 to form an outer surface of the housing. The side surface 1211 is an exterior surface of the front cover 120.

The front cover 120 caps at and seals the rear case 110. The front cover 120 and the rear case 110 cooperatively form an accommodating space. The speaker 130 is disposed in the accommodating space. A sound emitting part of the speaker 130 faces the front cover 120. The front cover 120 and the rear case 110 are made of plastic, synthetic resin, or metal, so that the housing 100 has a rigid structure and is not easy to be deformed. Therefore the electronic components in the housing 100 may be protected by the housing 100. The end surface 121 is disposed on an end of the front cover 120 away from the rear case 110.

The sound emitting nozzle 126 is connected to and protrudes from the end surface 121. The sound emitting nozzle 126 is hollow for allowing sounds from the speaker 130 to transmit to outside. In some embodiments, the sound emitting nozzle 126 is substantially cylindrical. The sound emitting nozzle 126 defines a first sound channel 128 communicating with the accommodating space. The sound emitted by the speaker 130 may pass through the first sound channel 128 and transmit to outside.

In some embodiments, the housing 100 includes a first holding portion 127 connected to the sound emitting nozzle 126. The first holding portion 127 is disposed on an end of the sound emitting nozzle 126 away from the end surface 121. The first holding portion 127 protrudes from an exterior surface of the sound emitting nozzle 126, and configured to engage with the first eartip 200 and the second eartip 300.

In one embodiment, the first holding portion 127 is substantially cyclic annular and surrounds the sound emitting nozzle 126. A diameter of the cross-sectional contour of the first holding portion 127 is larger than that of the sound emitting nozzle 126. So that when the first eartip 200 or the second eartip 300 is mounted on the housing 100, the first holding portion 127 can engage with the first eartip 200 or the second eartip 300, thereby avoiding the first eartip 200 or the second eartip 300 to detach from the housing 100. In another embodiment, the first holding portion 127 may include one or more protrude portions disposed on the exterior surface of the sound emitting nozzle 126. In still another embodiment, the contour of a cross-section of the sound emitting nozzle 126 may also be a polygon such as a triangle, a quadrangle, or a pentagon, which is not specifically limited herein. In one embodiment, the front cover 120, the sound emitting nozzle 126, and the first holding portion 127 cooperatively form an integrative structure.

Figure 11:
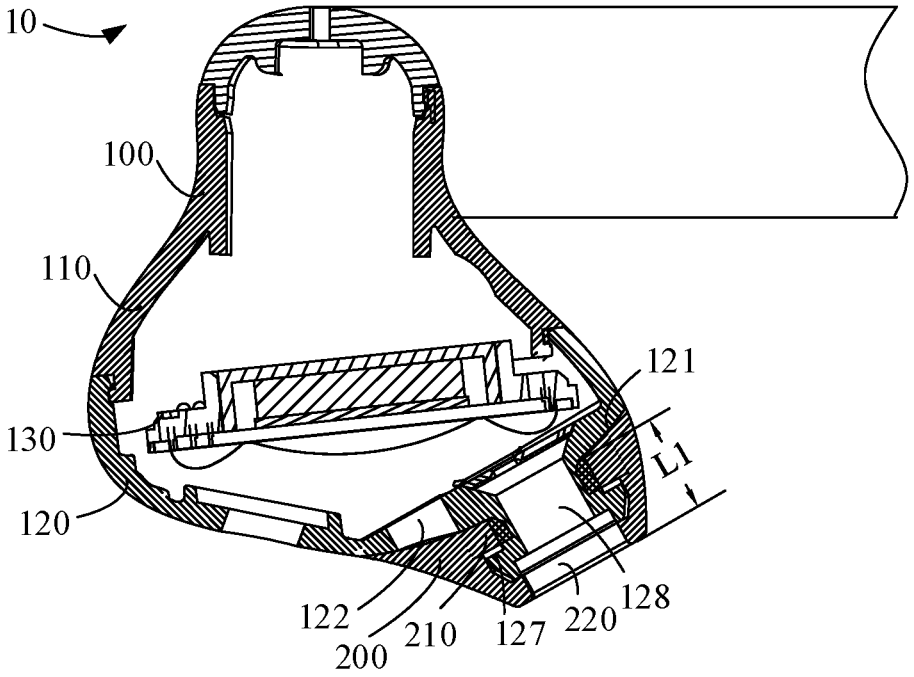
FIG. 11 illustrates a cross-sectional view of the earphone of FIG. 1.
Figure 12:
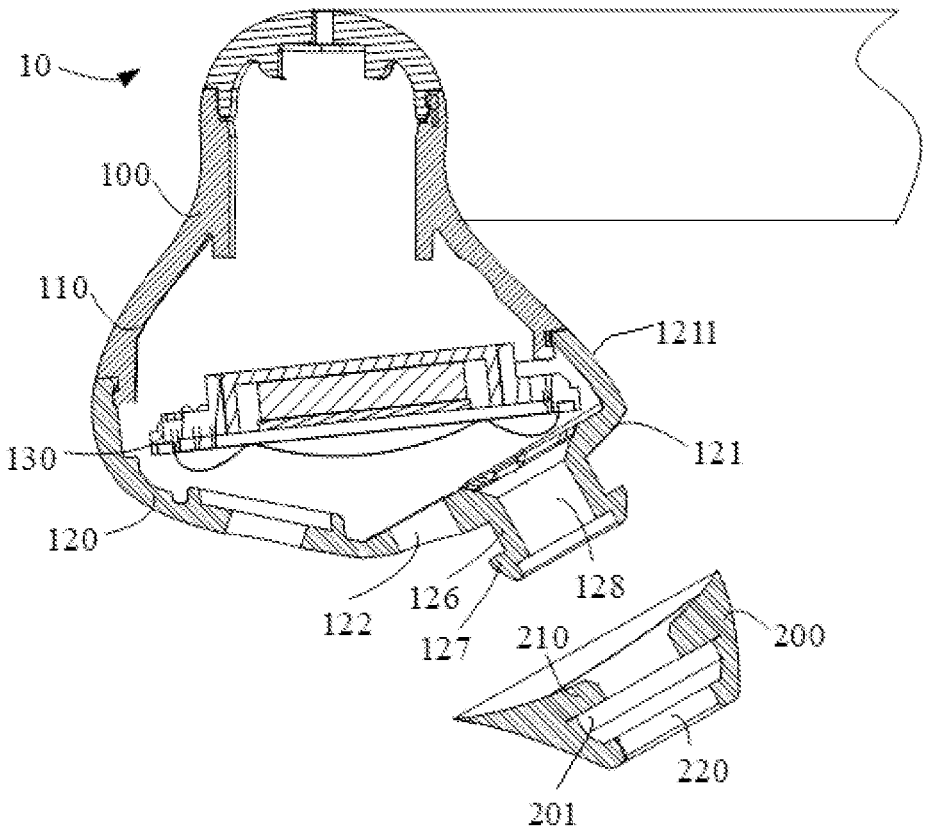
FIG. 12 illustrates a cross-sectional view of the earphone of FIG. 11, wherein the first eartip is apart from the housing.

As illustrated in FIGS. 11 and 12, in one embodiment, the first eartip 200 can be mounted on and detached from the housing 100. The first eartip 200 defines a second sound channel 220 therein. When the first eartip 200 is mounted on the housing 100, the first sound channel 128 may communicate with the second sound channel 220. So that the sound emitted by the speaker 130 can pass through the first sound channel 128 and the second sound channel 220 and transmit to outside.

The first eartip 200 is hollow, and includes a first interior wall 201 and a second holding portion 210. The first interior wall 201 defines the second sound channel 220. In the first configuration, the first eartip 200 encircles the sound emitting nozzle 126 via the first interior wall 201. The second holding portion 210 is disposed on and protrudes from the first interior wall 201. Thus the second holding portion 210 is disposed in the second sound channel 220. The second holding portion 210 is configured to engage with the first holding portion 127 so that the first eartip 200 is assembled to the housing 100 to avoid the first eartip 200 detaching from the housing 100. The second holding portion 210 is flexible and elastic. During the process of assembling the first eartip 200 to the housing 100, as the first eartip 200 approaching the housing 100, the second holding portion 210 is deformed and in contact with the first holding portion 127. Because the first holding portion 127 is harder and the second holding portion 210 is more flexible, the second holding portion 210 is deformed to provide a channel for the first holding portion 127 by squeezing, by which the second holding portion 210 can move to a side of the first holding portion 127 that facing the front cover 120. The first holding portion 127 and the second holding portion 210 are engaged with each other. An interference fit is formed between the second holding portion 210 and the surface of the sound emitting nozzle 126, thereby preventing air from flowing between the second holding portion 210 and the surface of the sound emitting nozzle 126. In an embodiment, the first eartip 200 may be made of a soft material such as rubber, resin, and silicon, and the first eartip 200 is an integrative structure.

Figure 13:
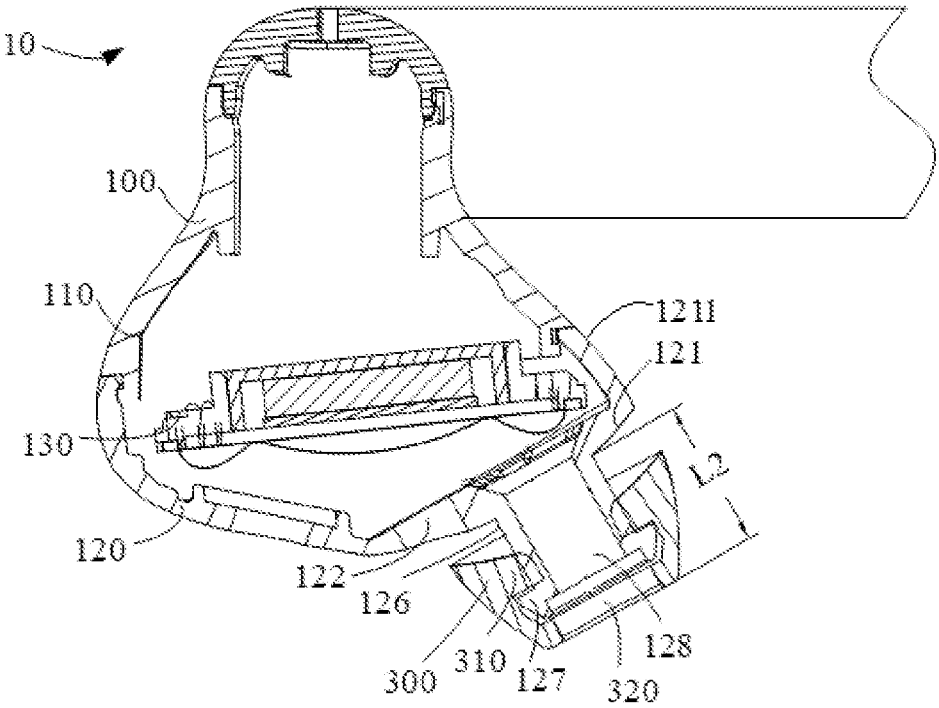
FIG. 13 illustrates a cross-sectional view of the earphone of FIG. 2, in accordance with an embodiment of the present disclosure.
Figure 14:
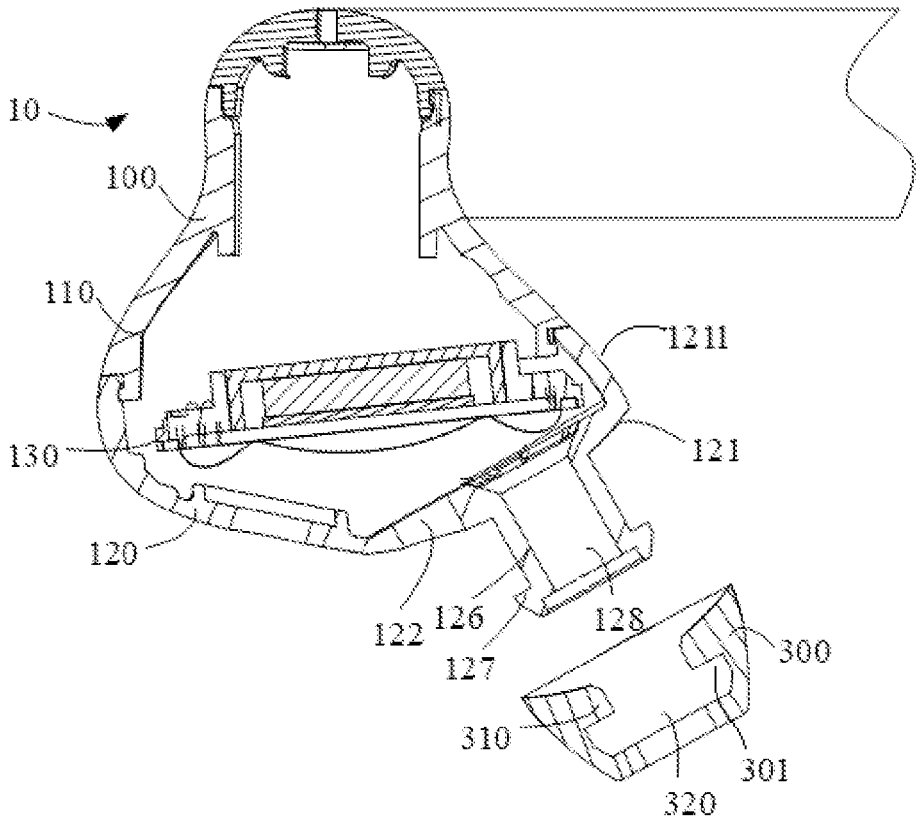
FIG. 14 illustrates a cross-sectional view of the earphone of FIG. 13, wherein the second eartip is apart from the housing.

As illustrated in FIGS. 13 and 14, in one embodiment, the second eartip 300 can be mounted on and detached from the housing 100. The second eartip 300 defines a third sound channel 320 therein. When the second eartip 300 is mounted on the housing 100, the first sound channel 128 communicates with the third sound channel 320. So that the sound emitted by the speaker 130 can pass through the first sound channel 128 and the third sound channel 320 and transmit to outside.

The second eartip 300 is hollow, and includes a second interior wall 301 and a third holding portion 310. The second interior wall 301 defines the third sound channel 320. In the second configuration, the second eartip 300 encircles the sound emitting nozzle 126 via the second interior wall 301. The third holding portion 310 is disposed on and protrudes from the second interior wall 301. Thus the third holding portion 310 is disposed in the third sound channel 320. The third holding portion 310 is configured to engage with the first holding portion 127 so that the second eartip 300 can be assembled to the housing 100 to avoid the second eartip 300 detaching from the housing 100. The third holding portion 310 is disposed in the third sound channel 310 is flexible and is elastic. During the process of assembling the second eartip 300 to the housing 100, as the second eartip 300 approaching the housing 100, the third holding portion 310 is deformed and in contact with and the first holding portion 127. Because the first holding portion 127 is harder and the third holding portion 310 is more flexible, the third holding portion 310 is deformed to provide a channel for the first holding portion 127 by squeezing, by which the third holding portion 310 can move to a side of the first holding portion 127 that facing the front cover 120. The first holding portion 127 and the third holding portion 310 are engaged with each other. An interference fit is formed between the third holding portion 310 and the surface of the sound emitting nozzle 126, thereby preventing air from flowing between the third holding portion 310 and the surface of the sound emitting nozzle 126. In an embodiment, the second eartip 300 may be made of soft material such as rubber, resin, and silicon, and the second eartip 300 is an integrative structure.

As illustrated in FIG. 11, in an embodiment, the front cover 120 defines a vent hole 122 therein. The vent hole 122 extends to the end surface 121, that is, the vent hole 122 penetrates the front cover 120 in a thickness direction of the front cover 120. So that the air in the housing 100 can flow out. The vent hole 122 is adjacent to the sound emitting nozzle 126 but apart from the sound emitting nozzle 126 for a certain distance. When the first eartip 200 is mounted on the housing 100, the first eartip 200 is stacked on the end surface 121 and in contact with the side surface 1211 smoothly. Thus the vent hole 122 is covered by the first eartip 200. The contour of the edge of the first eartip 200 coincides with the contour of the edge of the end surface 121. The first eartip 200 and the housing 100 form an integral shape, and the first eartip 200 covers and seals the vent hole 122. The distance between an end of the first eartip 200 away from the housing 100 and the end surface 121 is L1.

When the user wears the earphone 10 with the first eartip 200, the first eartip 200 is inserted into the auditory meatus 20. The depth that the first eartip 200 extends in the auditory meatus 20 is relatively small, and the rest of the earphone 10 is maintained outside the auditory meatus 20. The first eartip 200 is closely fitted to the auditory meatus 20 and can be deformed according to the shape of the auditory meatus 20. So that the seal between the earphone 10 and the auditory meatus 20 is better, and the airtightness of the front cavity 40 is better than a common semi-in-ear headphone. Therefore a sound insulation of the headphones 10 is better, and the low-frequency response of acoustic performance is better. For different people, the first eartip 200 may be designed in different sizes according to different sizes of the auditory meatus 20 of people, so that the earphone 10 of the present disclosure can be adapted to different people.

As illustrated in FIG. 13, in an embodiment, an outside diameter of the first eartip 200 is smaller than that of the second eartip 300. When the second eartip 300 is mounted on the housing 100, an area surrounded by the contour of the edge of the second eartip 300 is smaller than an area surrounded by the contour of the edge of the end surface 121. The second eartip 300 is apart from the end surface 121. Thus the vent hole 122 is exposed, and there is a gap between the second eartip 300 and the end surface 121. The distance between the end of the second eartip 300 away from the housing 100 and the end surface 121 is L2. L2 is greater than L1. Therefore, a distance that the first eartip 200 extends in the auditory meatus 20 is smaller than a distance that the second eartip 300 extends in the auditory meatus 20 when received in the auditory meatus.

When the user wears the earphone 10 with the second eartip 300, the second eartip 300 is inserted into the auditory meatus 20. A depth that the second eartip 300 extends in the auditory meatus 20 is relatively larger. The rest of the earphone 10 is maintained outside the auditory meatus 20. The second eartip 300 can be closely fitted to the auditory meatus 20 and can be deformed according to the shape of the auditory meatus 20 to improve the comfort of the user. The vent hole 122 of the earphone 10 will not be covered by the second eartip 300, so that the air in the housing 100 can flow out from the vent hole 122, which can reduce the airtightness of the front cavity 40, and can solve the problem of poor wearing experience caused by the difference in air pressure between the inside and outside the auditory meatus 20, also makes the airtightness and acoustic characteristics of the earphone 10 that works as the in-ear structure closer to that of the earphone 10 works as the semi-in-ear earphone. Therefore, the sound qualities of the earphone 10 that works as the semi-in-ear and the in-ear are substantially the same. For different people, the second eartip 300 may be designed in different sizes according to different sizes of the auditory meatus 20 of people, so that the earphone 10 of the present disclosure can be adapted to different people.

In another embodiment, the sound emitting nozzle 126 protrudes from the end surface 121 of the front cover 12. The vent hole 122 is defined in the wall of the sound emitting nozzle 126 and is located at an end of the sound emitting nozzle 126 adjacent to the end surface 121. When the first eartip 200 is mounted on the housing 100, the vent hole 122 is covered and sealed by the second holding portion 210. Thus the airtightness of the front cavity 40 is better than that of a common semi-in-ear earphone, which may achieve a better sound insulation of the earphone 10, and the low frequency response of acoustic performance is better. When the second eartip 300 is mounted on the housing 100, the vent hole 122 is located by a side of the third holding portion 310 adjacent to the end surface 121, so that the vent hole 122 is not sealed by the third holding portion 310. That is, the vent hole 122 is not covered or sealed by the second eartip 300 and exposed, so that the air in the first sound channel 128 can flow out from the vent hole 122, which can reduce the airtightness of the front cavity 40, and can solve the problem of poor wearing experience caused by the difference in air pressure between the inside and outside the auditory meatus 20, also makes the airtightness and acoustic characteristics of the earphone 10 that works as the in-ear structure closer to that of the earphone 10 works as the semi-in-ear earphone. Therefore, the sound qualities of the earphone 10 that works as the semi-in-ear and the in-ear are substantially the same.

Figure 15:
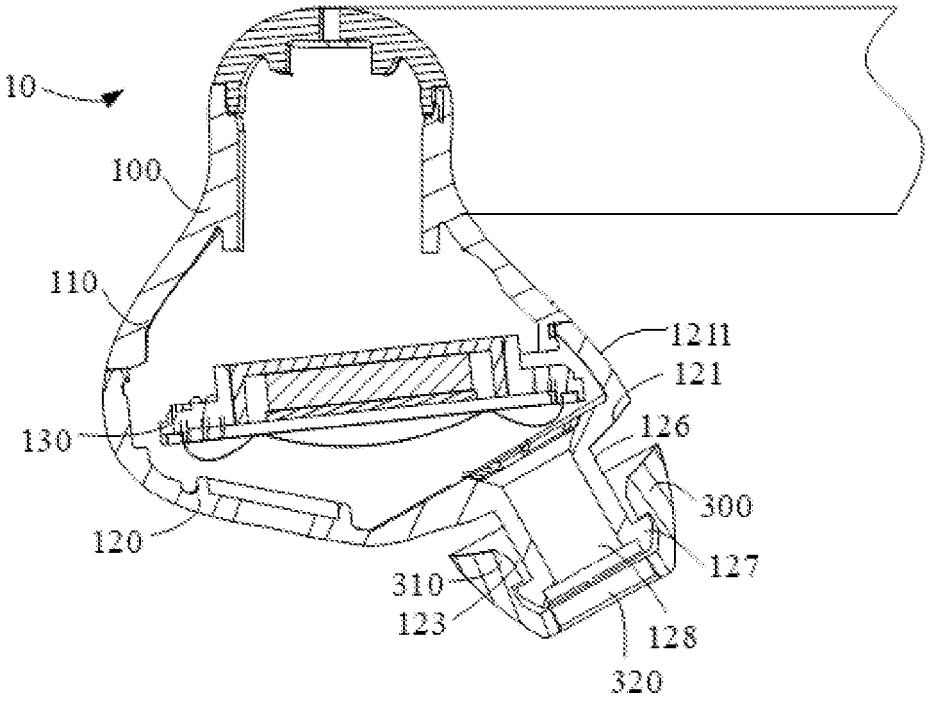
FIG. 15 illustrates a cross-sectional view of the earphone of FIG. 2, in accordance with another embodiment of the present disclosure.

As illustrated in FIG. 15, in an embodiment, the vent channel is a gap defined by the second eartip 300 and the housing 100. When the second eartip 300 is mounted on the housing 100, the third holding portion 310 is engaged with the first holding portion 127. There is a gap 123 between the third holding portions 310 and the sound emitting nozzle 126. The gap 123 defines the vent channel of the earphone 10. The airtightness between the second eartip 300 and the sound emitting nozzle 126 may be reduced via the gap 123. So that the air in the housing 100 can pass through the first sound channel 128, the third sound channel 320, and the gap 123 in sequence and flow out, thereby reducing the airtightness of the front cavity 40, and solving the problem of poor wearing experience caused by the difference in air pressure between the inside and outside the auditory meatus 20, also makes the airtightness and acoustic characteristics of the earphone 10 that works as the in-ear structure closer to that of the earphone 10 works as the semi-in-ear earphone. Therefore, the sound qualities of the earphone 10 that works as the semi-in-ear and the in-ear are substantially the same.

Figure 16:
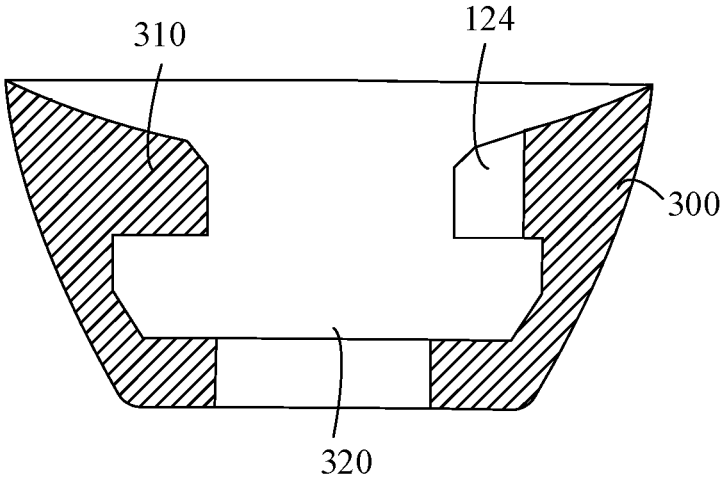
FIG. 16 illustrates a cross-sectional view of the second eartip of the earphone of FIG. 2, in accordance with another embodiment of the present disclosure.
Figure 17:
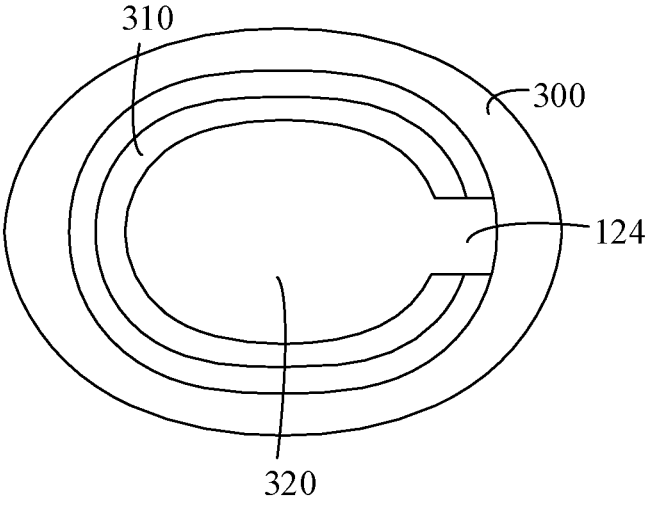
FIG. 17 illustrates a top view of the second eartip of FIG. 16.

In some embodiments, the vent channel is a notch defined in the second eartip 300. As illustrated in FIG. 16 and FIG. 17, the third holding portion 310 of the second eartip 300 defines a notch 124 therein. When the second eartip 300 is mounted on the housing 100, the third holding portion 310 is engaged with the first holding portion 127. The notch 124 in the third holding portion 310 defines the vent channel of the earphone 10. So that the air in the housing 100 can pass through the first sound channel 128, the third sound channel 320, and the gap 123 in sequence and flow out, thereby reducing the airtightness of the front cavity 40, and solving the problem of poor wearing experience caused by the difference in air pressure between the inside and outside the auditory meatus 20, also makes the airtightness and acoustic characteristics of the earphone 10 that works as the in-ear structure closer to that of the earphone 10 works as the semi-in-ear earphone. Therefore, the sound qualities of the earphone 10 that works as the semi-in-ear and the in-ear are substantially the same.

In the earphone 10 provided by the present disclosure, the first eartip 200 and the second eartip 300 having different sizes and shapes can be detachably mounted on the housing 100. The depth of the ear of the earphone 10 may be changed via the first eartip 200 and the second eartip 300. So that the earphone 10 can be used as a semi-in-ear earphone or an in-ear earphone, which can adjust the acoustic characteristics of the front cavity 40, thereby adjusting the acoustic performance of the headphones 10. When the first eartip 200 is mounted on the housing 100, the earphone 10 works as a semi-in-ear earphone. When the user wears the earphone 10 with the first eartip 200, the first eartip 200 is inserted into the auditory meatus 20, which does not generate pressure on the auditory meatus 20 and is not easy to detach from the auditory meatus 20, and the user experience is better. When the first eartip 200 is received in the auditory meatus 20, the first eartip 200 can cooperate well with the auditory meatus 20, which may achieve a good sound insulation, and makes the airtightness of the front cavity 40 better, and improves the acoustic performance of the earphone 10.

When the second eartip 300 is mounted on the housing 100, the earphone 10 works as an in-ear earphone. When the user wears the earphone 10 with the second eartip 300, the second eartip 300 is inserted into the auditory meatus 20, which does not generate pressure on the auditory meatus 20 and is not easy to detach from the auditory meatus 20, and the user experience is better. The second eartip 300 can reduce the airtightness of the front cavity 40 via the air vent hole 122 or the air vent channel, thereby avoiding a pressure difference between the auditory meatus 20 and the outside world, and thereby avoiding an echo of the sound when speaking. Therefore an openness of the sound quality of the earphone 10 is improved. When the second eartip 300 is assembled to the housing 100, the depth that the earphone 10 extends in the auditory meatus 10 is smaller than that of a common in-ear earphone. So that the problem of intrusive feeling when the user wears the earphone 10 can be weakened. The airtightness of the front cavity 40 that is defined by the earphone 10 with the first eartip 200 is substantially approximate to the airtightness of the front cavity 40 that is defined by the earphone 10 with the second eartip 300. So that the earphone 10 may have similar acoustic characteristics in both conditions of the earphone 10 when equipped with the first eartip 200 and the second eartip 300. The sound qualities of both the two conditions are not easily affected.

The technical features of the embodiments described above can be arbitrarily combined. In order to simplify the description, all possible combinations of the technical features in the above embodiments have not been described. However, as long as there is no contradiction in the combination of these technical features, it should be considered as the scope described in this specification.

The above-mentioned embodiments only express several implementation manners of the present disclosure, and their descriptions are more specific and detailed, but they cannot be understood as a limitation on the scope of patent disclosure. It should be noted that, for those of ordinary skill in the art, without departing from the concept of the present disclosure, several modifications and improvements can be made, which all belong to the protection scope of the present disclosure. Therefore, the protection scope of this disclosure patent shall be subject to the appended claims.

What is claimed is:

1. An earphone, comprising:

a housing defining a vent hole therein;

a first eartip, configured to be mounted on the housing and cover the vent hole; and a second eartip, configured to be mounted on the housing and exposing the vent hole;

wherein the housing selectively cooperates with one of the first eartip and the second eartip;

wherein the housing comprises a front cover, a sound emitting nozzle and a first holding portion, the front cover defines a first sound channel therein, the sound emitting nozzle protrudes from the front cover, the first holding portion is connected to the sound emitting nozzle, the second eartip comprises a third holding portion configured to engage with the first holding portion; and wherein the vent hole is defined in an end of the sound emitting nozzle adjacent to the front cover and in communication with the first sound channel, and the vent hole is exposed and located by a side of the third holding portion adjacent to the front cover when the second eartip is mounted on the housing.

2. The earphone according to claim 1, wherein the first eartip defines a second sound channel;

wherein the second sound channel is in communication with the first sound channel when the first eartip is mounted on the housing; the second eartip defines a third sound channel; and wherein the third sound channel and the vent hole are both communicated with the first sound channel when the second eartip is mounted on the housing.

3. The earphone according to claim 2, wherein the first sound channel penetrates the front cover and the sound emitting nozzle; and wherein the first holding portion selectively cooperates with one of the first eartip and the second eartip.

4. The earphone according to claim 3, wherein the first eartip comprises a second holding portion configured to engage with the first holding portion to connect the first eartip to the sound emitting nozzle; and wherein the second holding portion is in interference fit with the sound emitting nozzle when the second eartip is connected to the sound emitting nozzle.

5. The earphone according to claim 3, wherein the housing comprises a rear case connected to the front cover;

wherein the front cover comprises an end surface disposed on an end thereof far away from the rear case; and wherein the sound emitting nozzle protrudes from the end surface.

6. The earphone according to claim 5, wherein the rear case and the front cover cooperatively form an accommodating space; and wherein the earphone comprises a speaker received in the accommodating space.

7. The earphone according to claim 1, wherein the first eartip and the second eartip are made of silicon.

8. An earphone configured to be adapted with an auditory meatus, comprising:

a housing, having an end surface and a side surface connected to an outer periphery of the end surface;

a first eartip, configured to be mounted on the housing detachably; and a second eartip, configured to be mounted on the housing detachably and define a vent channel cooperatively with the housing, and the vent channel communicating with the inside and the outside of the housing;

wherein the housing is selectively cooperated with one of the first eartip and the second eartip;

wherein the first eartip is in contact with the side surface when engaged with the housing, and the first eartip is in contact with the auditory meatus when received in the auditory meatus; and wherein a cross-sectional size of the second eartip is smaller than a size of the end surface, and the second eartip is in contact with the auditory meatus when received in the auditory meatus, and the vent channel is in communication with the auditory meatus.

9. The earphone according to claim 8, wherein the housing comprises a front cover and a sound emitting nozzle protruding from the front cover;

wherein the sound emitting nozzle is configured to engaged with the first eartip and the second eartip; and wherein the first eartip encircles and has an interference fit with the sound emitting nozzle, and separates the vent channel from outside when engaged with the housing.

10. The earphone according to claim 9, wherein the second eartip encircles and has a clearance fit with the sound emitting nozzle, and the vent channel is defined between the second eartip and the sound emitting nozzle.

11. The earphone according to claim 9, wherein the second eartip encircles and has an interference fit with the sound emitting nozzle;

wherein the second eartip defines a notch in an interior surface thereof; and wherein the vent channel is defined by the notch.

12. The earphone according to claim 9, wherein the housing defines a vent hole therein; and the vent hole is exposed when the second eartip is engaged with the housing; and wherein the vent channel is defined by the vent hole; the vent hole is covered by the first eartip when the first eartip is engaged with the housing.

13. The earphone according to claim 12, wherein the housing comprises a front cover and a rear case connected to the front cover; the end surface is disposed on the front cover;

wherein the sound emitting nozzle protruding from the end surface;

wherein the vent hole is defined in the front cover;

wherein the first eartip is stacked on the end surface when engaged with the housing; and wherein the second eartip is part from the end surface when engaged with the housing.

14. The earphone according to claim 9, wherein a vent hole is defined in an end of the sound emitting nozzle adjacent to the end surface;

wherein the first eartip seals the vent hole when the first eartip encircles the sound emitting nozzle; and wherein the vent hole is exposed and disposed by a side of the second eartip that adjacent to the end surface when the second eartip is mounted on the sound emitting nozzle.

15. The earphone according to claim 8, wherein a distance between an end of the first eartip far away from the housing and the end surface is smaller or equal to a distance between an end of the second eartip far away from the housing and the end surface;

wherein a contour of the first eartip coincides with a contour of the end surface.

16. An earphone configured to be adapted with an auditory meatus, comprising a housing, a first eartip and a second eartip;

wherein the first eartip and the second eartip are both configured to be detachably cooperated with the housing, the earphone is configured to switch between a first configuration that the housing is engaged with the first eartip and a second configuration that the housing is engaged with the second eartip;

wherein the housing has an end surface and a side surface connected to an outer periphery of the end surface, the first eartip is in contact with the side surface when engaged with the housing; and wherein the second eartip defines a notch in an interior surface thereof, the notch communicates with the inside and the outside of the housing when the second eartip is mounted on the housing, and a cross-sectional size of the second eartip is smaller than a size of the end surface.

17. The earphone according to claim 16, wherein the housing comprises a front cover and a sound emitting nozzle connected to the front cover;

wherein the sound emitting nozzle is configured to engage with the first eartip and the second eartip.

18. The earphone according to claim 17, wherein the housing further comprises a first holding portion connected to the sound emitting nozzle, the first eartip comprises a second holding portion configured to engage with the first holding portion, and the second eartip comprises a third holding portion configured to engage with the first holding portion.

19. The earphone according to claim 18, wherein the notch is defined in the third holding portion.

20. The earphone according to claim 17, wherein the earphone further comprises a speaker, the housing further comprises a rear case, the front cover and the rear case cooperatively form an accommodating space, the speaker is disposed in the accommodating space, and the sound emitting nozzle is hollow for allowing sounds from the speaker to transmit to the outside.

* * * * *